US007793701B2

(12) United States Patent
Liang et al.

(10) Patent No.: US 7,793,701 B2
(45) Date of Patent: Sep. 14, 2010

(54) OPERATION WAND ASSEMBLY OF CURTAINS

(75) Inventors: Wen Ying Liang, Fuxing Shiang (TW); Sheng Ying Hsu, Fuxing Shiang (TW); Wu Chung Nien, Fuxing Shiang (TW); Chien Chih Huang, Fuxing Shiang (TW)

(73) Assignee: Ching Feng Home Fashions Co., Ltd, Changhua County (TW)

( * ) Notice: Subject to any disclaimer, the term of this patent is extended or adjusted under 35 U.S.C. 154(b) by 281 days.

(21) Appl. No.: 12/071,732

(22) Filed: Feb. 26, 2008

(65) Prior Publication Data

US 2009/0194240 A1 Aug. 6, 2009

(30) Foreign Application Priority Data

Feb. 5, 2008 (TW) ..... 97202504 U

(51) Int. Cl.
*E06B 9/38* (2006.01)

(52) U.S. Cl. ..... 160/178.1 R; 16/422; 294/19.1

(58) Field of Classification Search ..... 160/178.1 R, 160/177 R, 178.1 V, 84.04, 84.05, 84.06, 160/341; 294/19.1; 16/422, 426
See application file for complete search history.

(56) References Cited

U.S. PATENT DOCUMENTS 2,086,461 A * 7/1937 Bogan ..... 160/173 R
2,537,828 A * 1/1951 Hoffman ..... 160/384
2,751,653 A * 6/1956 Leibow ..... 24/331
3,423,781 A * 1/1969 Henson ..... 15/145
4,088,173 A * 5/1978 Antich ..... 160/238
4,593,737 A * 6/1986 Clemente ..... 160/84.06
4,875,516 A * 10/1989 Marocco ..... 160/178.1 R
5,002,113 A * 3/1991 Georgopoulos ..... 160/176.1 R
5,092,387 A * 3/1992 King et al. ..... 160/176.1 R
5,186,229 A * 2/1993 Hsu ..... 160/176.1 R
5,553,653 A * 9/1996 Rozon ..... 160/173 R
6,044,890 A * 4/2000 Renee ..... 160/177 R
6,308,764 B1 * 10/2001 Lin ..... 160/177 R
6,805,186 B1 * 10/2004 Nien ..... 160/177 R
7,204,292 B2 * 4/2007 Nien ..... 160/168.1 R
2007/0084567 A1 * 4/2007 Chen ..... 160/84.05
2007/0151059 A1 * 7/2007 Petner et al. ..... 15/145

* cited by examiner

*Primary Examiner*—David Purol

(57) ABSTRACT

A operation wand assembly of a curtain a curved connection member adapted to be connected to the lower rail of the curtain and having a top recess. A through hole is defined through the curved connection member and communicates with the top recess. An engaging member is received in the top recess and has a tubular portion engaged with the through hole of the curved connection member. The tubular portion includes an open bottom and two connection grooves are defined through a wall of the tubular portion. An operation wand has two radial rods extending from a top thereof and the top of the operation wand is removably inserted into the open bottom of the tubular portion. The two radial rods are engaged with the connection grooves. The operation wand can be hooked to a positioning member on a wall when not in use.

5 Claims, 6 Drawing Sheets

OPERATION WAND ASSEMBLY OF CURTAINS

FIELD OF THE INVENTION

The present invention relates to an operation wand assembly of curtains and the wand is easily connected to or disengaged from the connection member on the lower bar of the curtain.

BACKGROUND OF THE INVENTION

A conventional curtain is shown in FIG. 6 and generally includes a top case 41 which is a U-shaped case with driving mechanism received therein. A top bar 42 is connected to the top of the curtain 43 and connected to one of the driving mechanism. The curtain 43 is connected to the other driving mechanism by wires so as to change the tilt angles of the slats of the curtain 43. A collar 44 is mounted to the top transverse bar 42 and includes a hook 441 which protrudes out from the top transverse bar 42. An operation wand 45 includes an enlarged end 451 which is engaged with the hook 441 via the opening 442 of the hook 441 so that the wand 55 can be easily connected to the hook 441 or removed from the hook 441. By pulling or lifting the operation wand 45, the curtain 43 can be pulled down or lifted upward. Nevertheless, because the hook 441 is located on the top transverse bar 42 which is located at a distance from the user so that the user has to carefully hook the enlarged end 451 with the hook 441 via the opening 442, sometimes, it takes too much time for some users. Another problem is that the user cannot find the wand 45 often because there is no proper positioning device for positioning the wand 45.

The present invention intends to provide an operation wand assembly which is easily engaged with the connection member on the lower transverse bar of the curtain and a positioning member is provided which is fixed on wall so that the operation wand can be positioned to the positioning member when not in use.

SUMMARY OF THE INVENTION

The present invention relates to an operation wand assembly of a curtain and comprises a curved connection member connected to an underside of the lower rail of the curtain and the curved connection member includes a top recess. A through hole is defined through the curved connection member and communicates with the top recess. An engaging member is received in the top recess and has a tubular portion which is engaged with the through hole of the curved connection member. The tubular portion includes an open bottom and two connection grooves are defined through a wall of the tubular portion. An operation wand has two radial rods extending from a top thereof and the top of the operation wand is removably inserted into the open bottom of the tubular portion. The two radial rods are engaged with the connection grooves.

The primary object of the present invention is to provide an operation wand assembly of a curtain and the wand can be easily connected with the engaging member connected to the curved connection member.

Another object of the present invention is to provide an operation wand assembly of a curtain wherein a positioning member is provided for positioning the wand on a wall when the wand is not in use.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
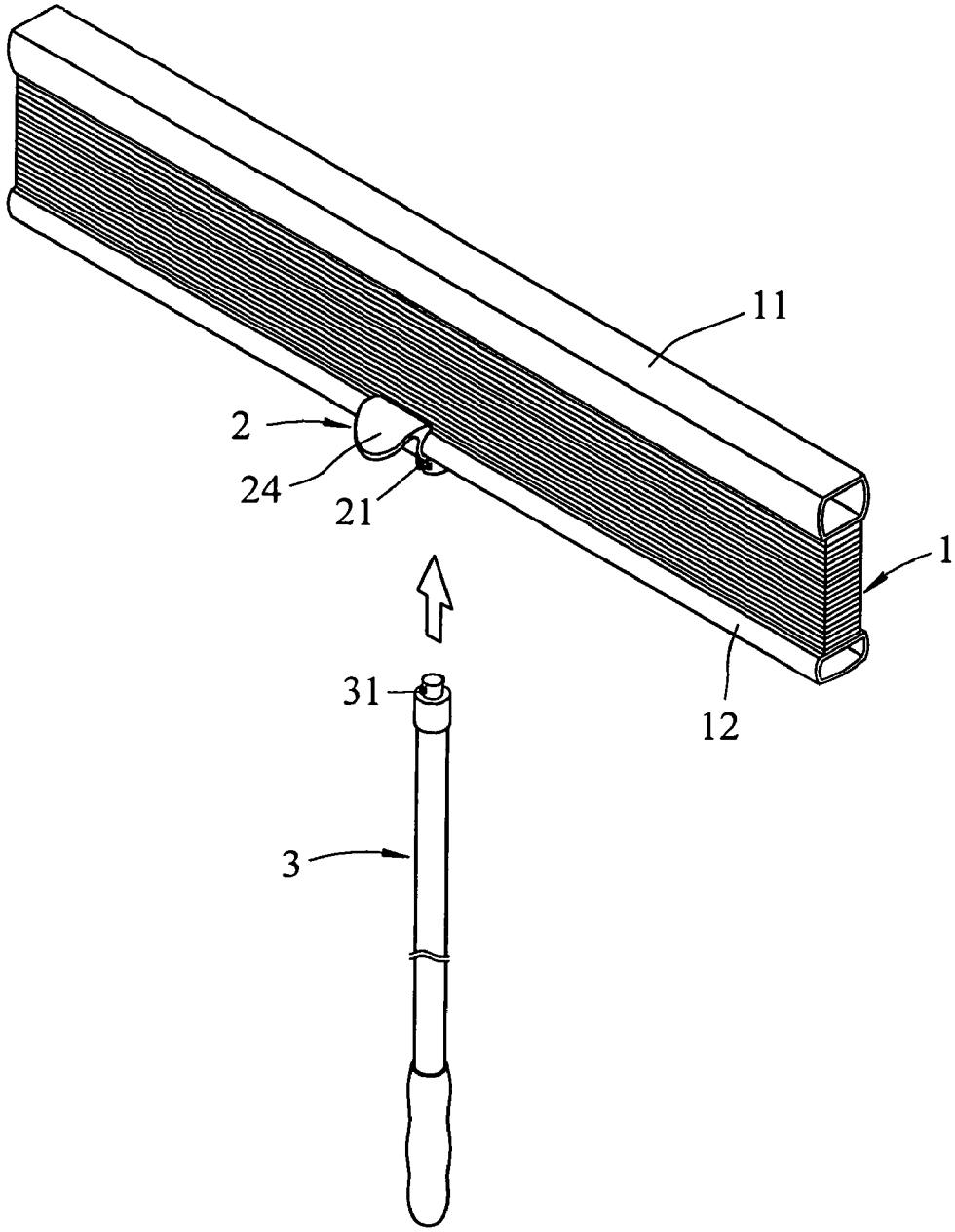
FIG. 1 is an exploded view to show the operation wand assembly of the present invention and the curtain.
Figure 2:
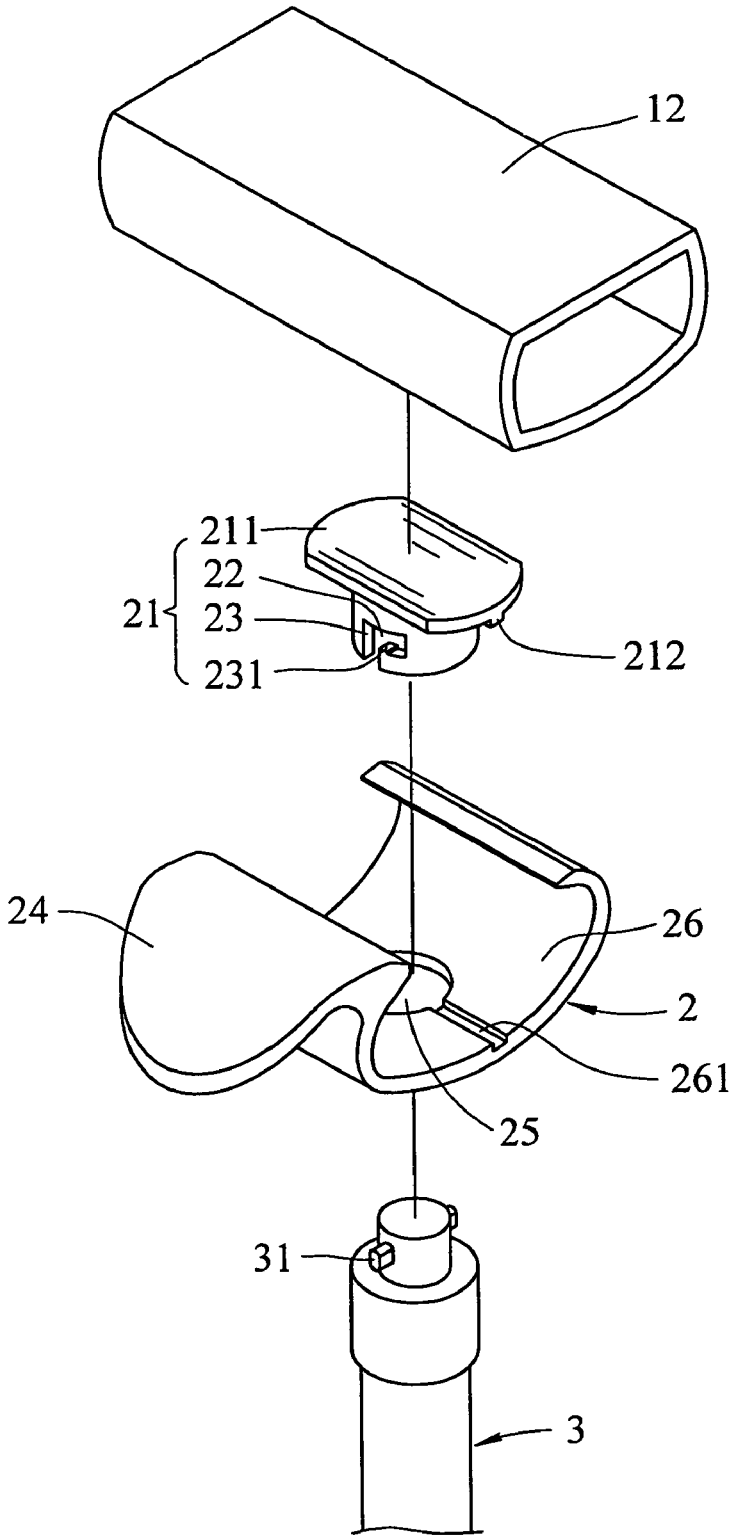
FIG. 2 is an exploded view to show the operation wand assembly of the present invention.
Figure 3:
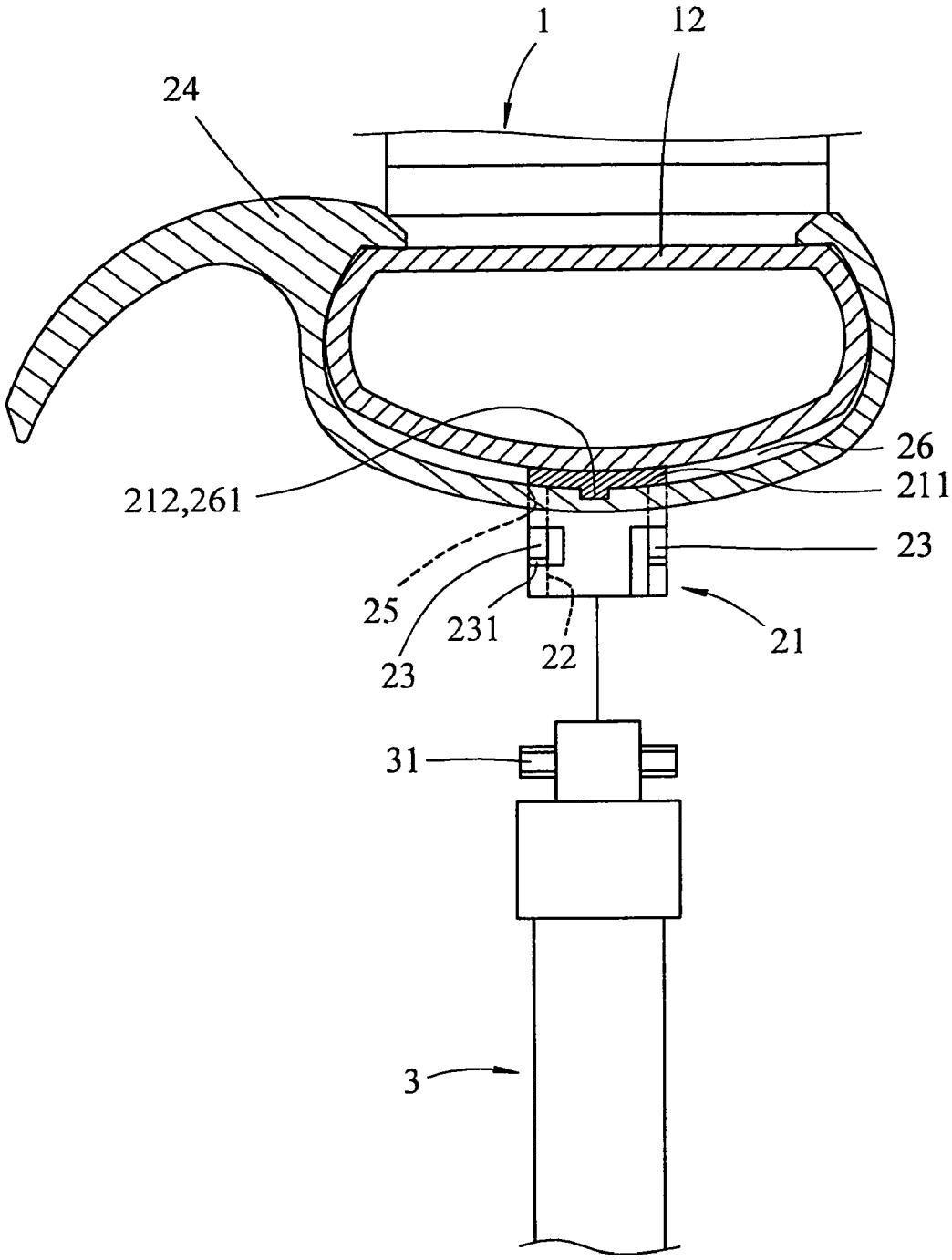
FIG. 3 is a partial cross sectional view to show that the operation wand is to be inserted into the tubular portion of the engaging member.

Referring to FIGS. 1 to 3, a curtain 1 includes a top rail 11, a lower rail 12 and a plurality of slats connected between the top rail 11 and the lower rail 12. The operation wand assembly of the present invention of a curtain comprises a curved connection member 2 which is connected to an underside of the lower rail 12 and has a top recess 26. A through hole 25 is defined through the curved connection member 2 and communicates with the top recess 26. A handle 24 extends from an end of the curved connection member 2 and includes a curved board with a recess defined in a bottom thereof, such that the user can easily catch the handle 24 by inserting fingers in the recess in the bottom of the handle 24 when needed. Two positioning grooves 261 are defined in a surface of the top recess 26 and communicate with the through hole 25.

An engaging member 21 is received in the top recess 26 and comprises a top plate 211 and a tubular portion which extends from an underside of the top plate 211 and is engaged with the through hole 25 of the curved connection member 2. The tubular portion includes an open bottom and two L-shaped grooves 23 are defined in a wall of the tubular portion. Each L-shaped groove 23 includes a horizontal portion and a vertical portion, the vertical portion opens the lower edge of the wall of the tubular portion. A protrusion 231 extends from a top of a surface defining of the horizontal portion of each of the L-shaped groove 23. The engaging member 21 includes a top plate 211 which includes two ridges 212 extending from the underside thereof and the two ridges 212 are engaged with the positioning grooves 261 so that the engaging member 21 does not spin when connected with the curved connection member 2.

Figure 4A:
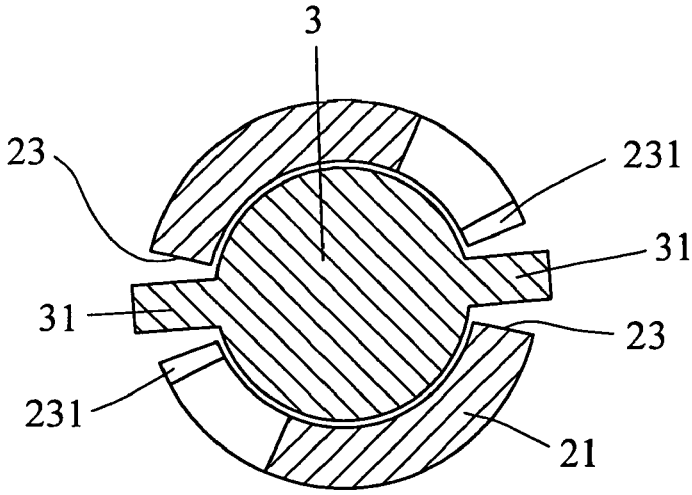
FIG. 4A is an end cross sectional view to show the radial rods pass through the vertical portions of the L-shaped connection grooves of the engaging member.
Figure 4B:
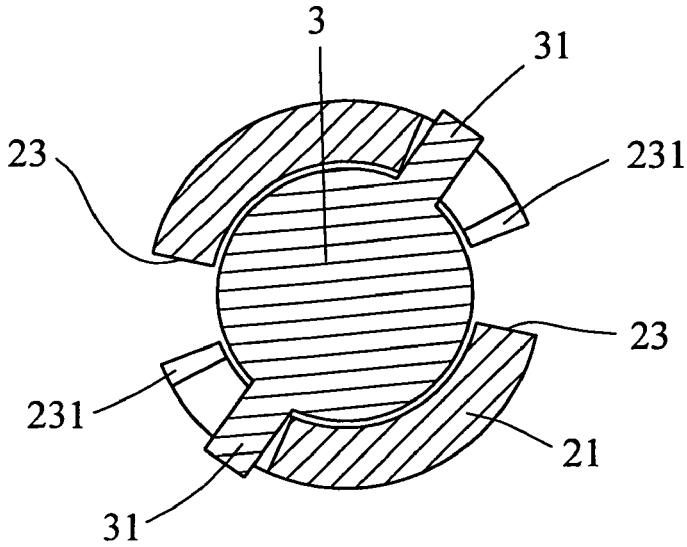
FIG. 4B is an end cross sectional view to show the radial rods are rotated to enter the horizontal portions of the L-shaped connection grooves of the engaging member.

Further referring to FIGS. 4A and 4B, an operation wand 3 includes two radial rods 31 extending from a top thereof. The top of the operation wand 31 is removably inserted into the open bottom of the tubular portion and the two radial rods 31 pass through the vertical portions of the two L-shaped grooves 23 and are rotated to enter the horizontal portions. When releasing the operation wand 3, the radial rods 31 are lowered and stopped by the two protrusions 231 so that the operation wand 3 is not disengaged from the connection grooves 23 when the user rotate the operation wand 3.

The connection member 2 is connected to the lower rail 12 of the curtain 1 and located close to the user so that the user can easily see the connection member 2. The operation wand 3 is vertically inserted into the open bottom of the engaging member 21 and this action is easy for the users.

Figure 5:
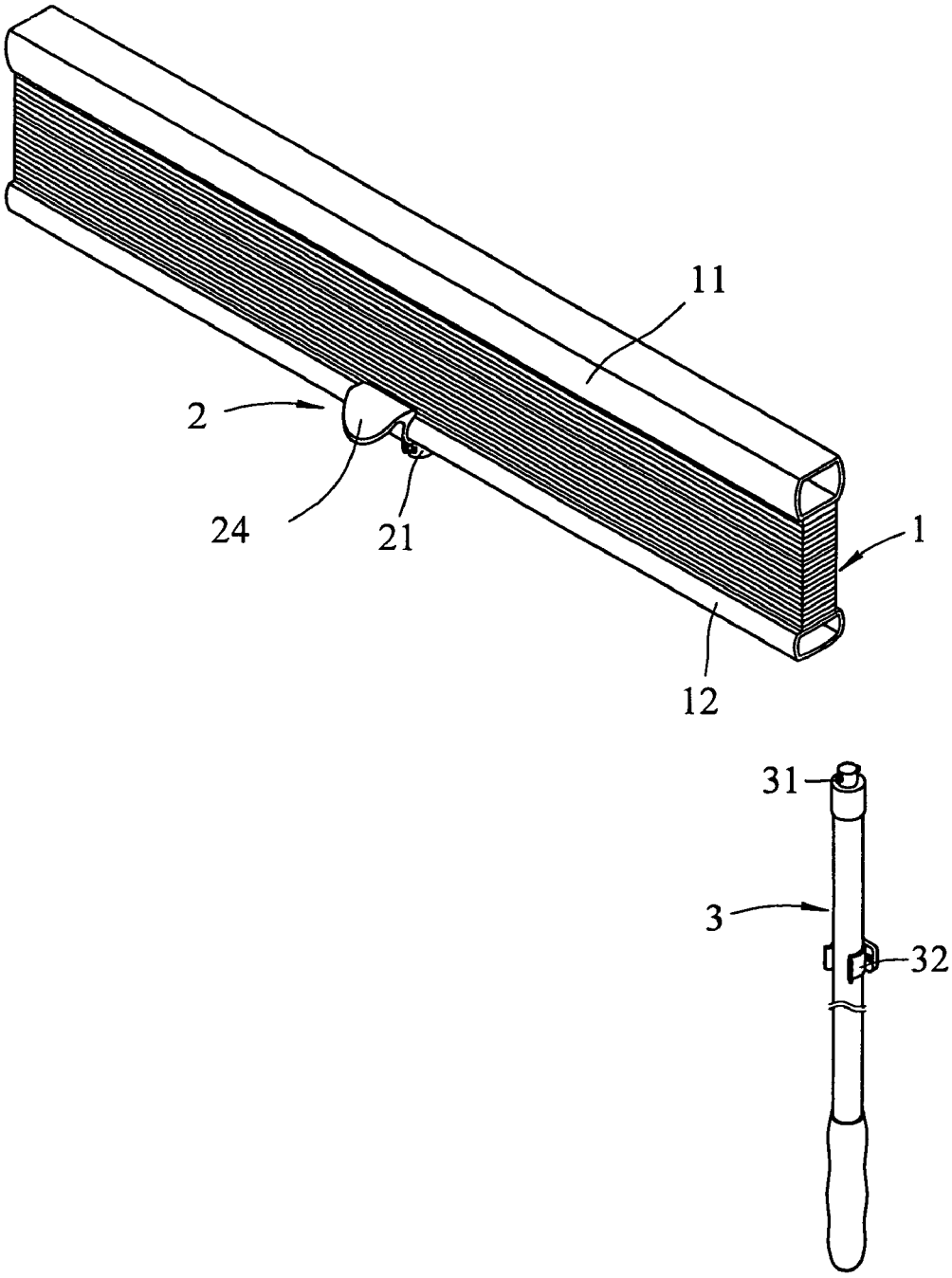
FIG. 5 shows that the operation wand is positioned to a positioning member on a wall.
Figure 6:
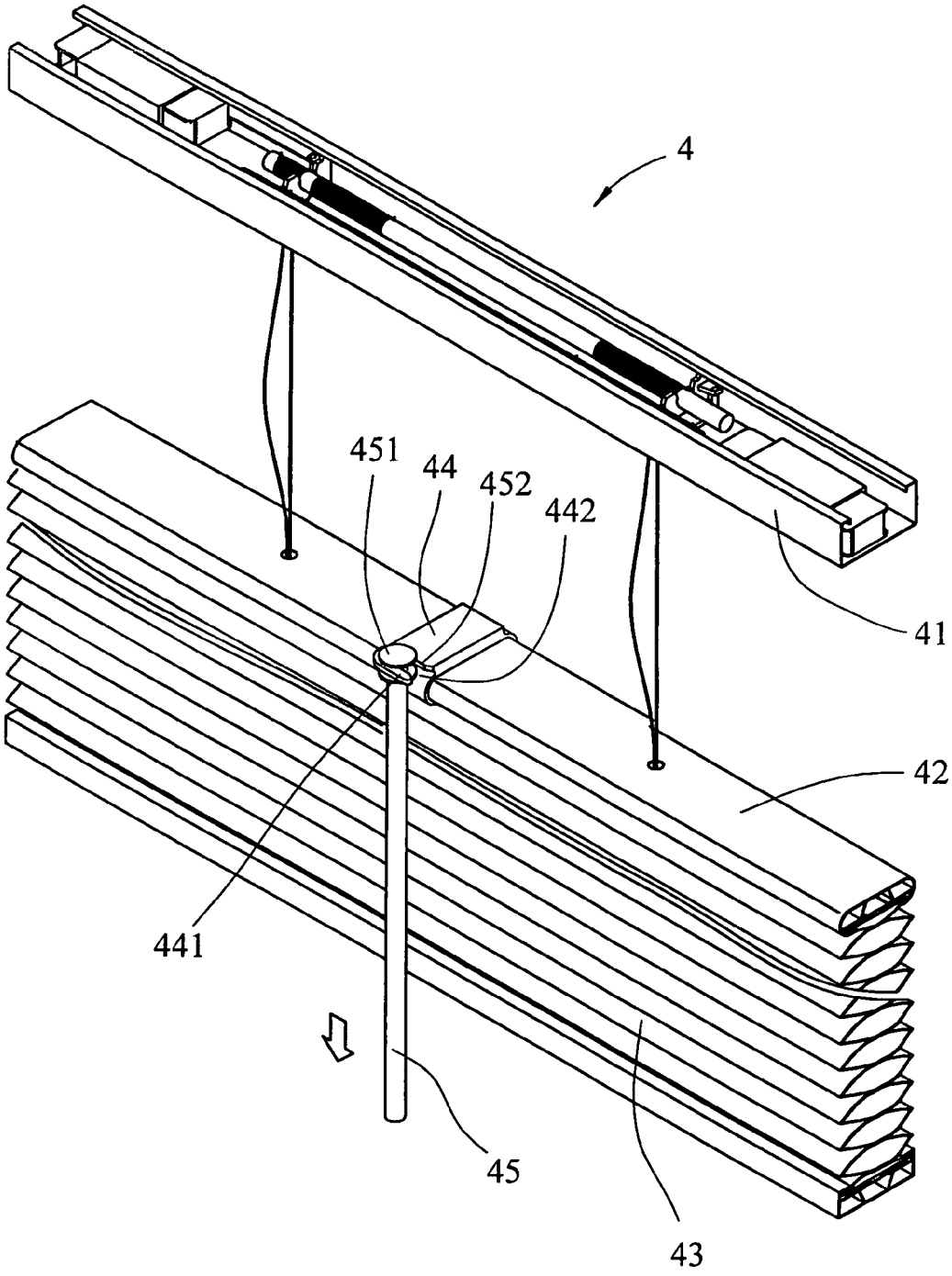
FIG. 6 PRIOR ART
FIG. 6 shows the conventional operation wand assembly and the curtain.

Referring to FIG. 5, a positioning member 32 is provided and is a C-shaped member which is fixed on a wall, so that the operation wand 3 is engaged with the positioning member 32 when not in use.

While we have shown and described the embodiment in accordance with the present invention, it should be clear to those skilled in the art that further embodiments may be made without departing from the scope of the present invention.

What is claimed is:

1. An operation wand assembly of a curtain which includes a top rail, a lower rail and a plurality of slats connected between the top rail and the lower rail, the operation wand assembly comprising:

a curved connection member adapted to be connected to an underside of the lower rail and having a top recess, a through hole defined through the curved connection member and communicating with the top recess, two positioning grooves defined in a surface of the top recess;

an engaging member including a top plate which includes two ridges extending from an underside thereof, the two ridges engaged with the positioning grooves of the top recess, the engaging member having a tubular portion which is engaged with the through hole of the curved connection member, the tubular portion including an open bottom and two connection grooves defined through a wall of the tubular portion, and an operation wand having two radial rods extending from a top thereof, the top of the operation wand removably inserted into the open bottom of the tubular portion and the two radial rods are engaged with the connection grooves.

2. The assembly as claimed in claim 1, wherein the curved connection member includes a handle extending from an end thereof.

3. The assembly as claimed in claim 2, wherein the handle is a curved board with a recess defined in a bottom thereof.

4. The assembly as claimed in claim 1, wherein the connection grooves each are an L-shaped groove which includes a horizontal portion and a vertical portion, the vertical portion opening the lower edge of the wall of the tubular portion, a protrusion extends from a top of a surface defining of the horizontal portion of each of the L-shaped connection grooves, the two radial rods pass through the vertical portions of the two L-shaped connection grooves and are rotated to enter the horizontal portions, the radial rods are stopped by the two protrusions.

5. The assembly as claimed in claim 1, wherein a positioning member is a C-shaped member and adapted to be fixed on a wall, the operation wand is engaged with the positioning member.

* * * * *